United States Patent [19]

Perkins

[11] Patent Number: 4,483,277

[45] Date of Patent: Nov. 20, 1984

[54] SUPERHEATED LIQUID HEATING SYSTEM

[76] Inventor: Eugene W. Perkins, Dawsonville, Ga. 30534

[21] Appl. No.: 500,343

[22] Filed: Jun. 2, 1983

[51] Int. Cl.[3] ..... F22B 3/06; F28C 3/00; F24C 9/00

[52] U.S. Cl. ..... 122/26; 237/1 R; 126/247

[58] Field of Search ..... 237/1 R, 13; 122/26; 126/247

[56] References Cited

U.S. PATENT DOCUMENTS 4,226,364 10/1980 Utesch ..... 237/13 X
4,277,020 7/1981 Grenier ..... 122/26 X

*Primary Examiner*—Henry Bennett
*Attorney, Agent, or Firm*—Scrivener, Clark, Scrivener and Johnson

[57] ABSTRACT

A heating system using two liquid heaters of the immersed rotor type is provided for supplying heated liquid to a heat exchanger, and the liquid heaters are alternately connected to and disconnected from the heat exchanger so that the disconnected heater will produce superheated liquid.

2 Claims, 1 Drawing Figure

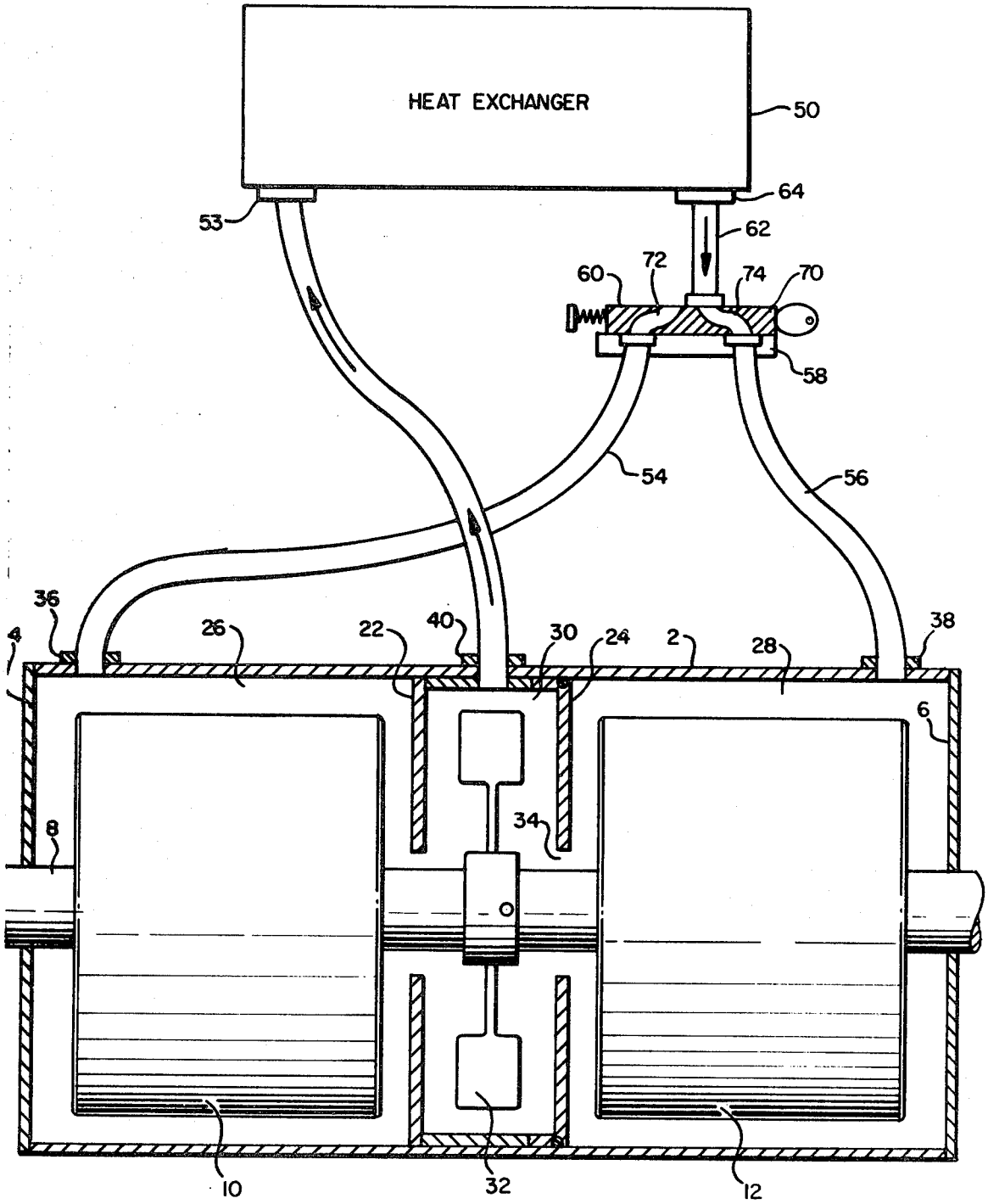
HEAT EXCHANGER
50
53
64
62
60
72
74
70
58
54
56
36
4
26
22
40
30
24
2
28
38
6
8
34
10
32
12

SUPERHEATED LIQUID HEATING SYSTEM

SUMMARY OF THE INVENTION

A heating system which may be portable or installed, for example in a residence or other building, utilizes as its source of heat a liquid heater comprising a chamber filled with a liquid in which a body is rotated to create friction in the liquid, which is then supplied to a heat exchanger external to the liquid heater. A heating system is provided having two such liquid heaters, together with means for alternately connecting each of the heaters to the heat exchanger while disconnecting the other heater from the heat exchanger, thereby producing superheated liquid in the closed liquid heater.

BACKGROUND OF THE INVENTION

A number of U.S. patents, and my co-pending application for patent Ser. No. 311,074, filed Oct. 13, 1981, for Heating Device, now abandoned describe and claim apparatus for producing heat by rotating a cylindrical body within a closed chamber containing a liquid, thereby producing friction and shearing action within the liquid and raising its temperature to a degree which makes the liquid a source of heat when supplied to a heat exchanger forming part of a heating system.

It is often necessary or desirable in the use of heating systems utilizing such liquid heaters to continuously provide to the heat exchanger liquid at a higher temperature than can normally be produced by a liquid heater of the type to which the invention relates, and it has therefore been the object of this invention to provide a liquid heater of that type, and a heating system utilizing such a liquid heater, which will produce superheated liquid for delivery to the heat exchanger.

BRIEF DESCRIPTION OF THE DRAWINGS

FIG. 1 is a part sectional and part elevational view of the heating system provided by the invention.

DESCRIPTION OF THE PREFERRED EMBODIMENT OF THE INVENTION

The invention provides a new and useful liquid heater and a heating system utilizing the heater to provide liquid at higher temperatures than may normally be provided by the pertinent type of liquid heater.

The liquid heater provided by the invention is disclosed in FIG. 1 and comprises a housing chamber defined by a cylindrical wall 2 and end walls 4, 6 through which there extends axially a shaft 8 on which there are mounted in spaced relation two cylindrical rotors 10, 12. Between the two rotors there are two parallel, axially spaced annular walls 22, 24 defining on either side the spaced rotor chambers 26, 28 and between them a compartment 30 within which there is mounted on the shaft a centrifugal type pump 32. The inner edges of the annular walls 22, 24 define a central opening 34 providing communication between the two rotor chambers and the pump chamber. The rotor chambers have, respectively, inlet ports 36, 38 and the pump chamber has outlet port 40. Any suitable means may be provided for rotating the shaft, the rotors and the pump.

The heating system provided by the invention utilizing the described double rotor and single pump liquid heating apparatus comprises a heat exchanger 50 comprising a screen and an elongated tubing through which liquid from the heater is passed, and which may be conventional in structure and operation or which may be modified as described and claimed in my co-pending application for U.S. patent Ser. No. 311,074 filed Oct. 13, 1981 for Heating Device, now abandoned. In the system according to the present invention the port 40 of the pump chamber 30 is connected by tubing 52 to the inlet port 53 of the tubing which forms part of the heat exchanger, and the ports 36, 38 of the rotor chambers 26, 28 are connected, respectively, by tubes 54, 56 to the fixed part 58 of a switching valve 60. A tube 62 leads from this valve to the outlet port 64 of the heat exchanger tubing, and the valve comprises a movable member 70 having two passages 72, 74 through it. Suitable means, such as that illustrated, may be provided for moving the valve part 70 to alternate positions, in one of which the outlet port 64 of the heat exchanger tubing is connected to rotor chamber 26 through tube 62, valve passage 72 and tube 54, and in the other of which the outlet port of the heat exchanger is connected to rotor chamber 28 through tube 62, valve passage 74 and tube 56.

In the use and operation of the described system the shaft is rotated to rotate the two rotors and the pump and the switching valve is operated in the manner described to cause each of the rotor chambers to be alternately connected into the heating system while the other rotor chamber is disconnected from the remainder of the heating system. In this latter condition the liquid in the disconnected rotor chamber will be superheated because the rotor operates without release of the liquid in its chamber to the rest of the system. Upon further operation of the valve the closed rotor chamber will be connected into the system and will deliver superheated liquid to the heat exchanger. At the same time as this occurs, the other rotor chamber will be closed at the switching valve to cause superheated liquid to be produced within it which will be delivered to the heat exchanger when the valve is again shifted.

I claim:

1. A heating system comprising:

(a) a first liquid heater comprising a chamber having a rotor rotatably mounted therein, and having an inlet port, (b) a second liquid heater comprising a chamber having a rotor rotatably mounted therein and having an inlet port, (c) a pump chamber and a pump rotatably mounted therein, and having an outlet port, (d) a heat exchanger comprising tubing having inlet and outlet ports, and (e) means for alternately i. connecting the outlet port of the pump chamber through the heat exchanger tubing to the inlet port of the first liquid heater and simultaneously disconnecting the second liquid heater from the heat exchanger tubing, and ii. connecting the outlet port of the pump chamber through the heat exchanger tubing to the inlet port of the second liquid heater and simultaneously disconnecting the first liquid heater from the heat exchanger tubing.

2. A heating system comprising:

(a) two liquid heaters each comprising:

i. a housing having a chamber defined by a cylindrical wall and end walls, and having an inlet port, ii. a rotor rotatably mounted within the chamber and having an external cylindrical surface coaxial with the chamber surface and spaced inwardly therefrom defining an annular rotor chamber adapted to receive a liquid to be heated by friction upon rotation of the rotor, (b) a third chamber having in it a rotary pump and having an outlet port, (c) a heat exchanger having an internal tube with inlet and outlet ports, and (d) means for alternately establishing liquid flow from the pump chamber outlet port through the heat exchanger tubing and the inlet port of one of the rotor chambers, and then from the pump outlet port through the heat exchanger tubing and the inlet port of the second rotor chamber.

* * * * *